US010539377B2

(12) United States Patent
Turney et al.

(10) Patent No.: US 10,539,377 B2
(45) Date of Patent: Jan. 21, 2020

(54) VARIABLE HEADERS FOR HEAT EXCHANGERS

(71) Applicant: Hamilton Sundstrand Corporation, Charlotte, NC (US)

(72) Inventors: Joseph Turney, Amston, CT (US); James Streeter, Torrington, CT (US); Neal R. Herring, East Hampton, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 201 days.

(21) Appl. No.: 15/404,850

(22) Filed: Jan. 12, 2017

(65) Prior Publication Data

US 2018/0195813 A1 Jul. 12, 2018

(51) Int. Cl.

| | |
|---|---|
| ***F28F 9/02*** | (2006.01) |
| ***F28F 9/22*** | (2006.01) |
| ***F28D 7/00*** | (2006.01) |

(52) U.S. Cl.

CPC ..... *F28F 9/02* (2013.01); *F28D 7/0066* (2013.01); *F28F 9/0243* (2013.01); *F28F 9/22* (2013.01)

(58) Field of Classification Search

CPC ..... F28F 9/02; F28F 9/0243; F28F 9/0263; F28F 9/22; F28F 9/0221; F28F 9/0275; F28F 9/0282; F28F 1/006; F28F 1/025; F28F 2009/029; F28F 2009/0287; F28F 13/08; F28D 7/0033; F28D 7/0066

See application file for complete search history.

(56) References Cited

U.S. PATENT DOCUMENTS

| | | | | |
|---|---|---|---|---|
| 8,726,976 | B2 | 5/2014 | Schrader et al. | |
| 2006/0048928 | A1* | 3/2006 | Maezawa | F25B 39/00 165/173 |
| 2006/0101850 | A1* | 5/2006 | Taras | F25B 39/028 62/515 |
| 2014/0196877 | A1 | 7/2014 | Wilkins et al. | |
| 2016/0131441 | A1 | 5/2016 | Newman et al. | |
| 2016/0202003 | A1 | 7/2016 | Gerstler et al. | |
| 2016/0265850 | A1 | 9/2016 | Kupiszewski et al. | |

FOREIGN PATENT DOCUMENTS

| | | | |
|---|---|---|---|
| EP | 0010817 | A1 | 5/1980 |
| EP | 2110636 | A1 | 10/2009 |
| WO | WO-2014010675 | A1 | 1/2014 |

OTHER PUBLICATIONS

European Extended Search Report prepared, of the European Patent Office, dated Jun. 18, 2018, issued in corresponding European Patent Application No. 18151296.3.

* cited by examiner

*Primary Examiner* — Travis C Ruby

(74) *Attorney, Agent, or Firm* — Locke Lord LLP; Daniel J. Fiorello; Scott D. Wofsy

(57) ABSTRACT

A heat exchanger header includes a plurality of first flow channels and second flow channels, each flow channel including a fluid circuit opening for fluid communication with a fluid circuit of a heat source and a core opening for communication with a heat exchanger core, wherein at least the first flow channels include a lobe section defining a non-uniform cross-sectional flow area that changes along a flow direction.

13 Claims, 9 Drawing Sheets

VARIABLE HEADERS FOR HEAT EXCHANGERS

BACKGROUND

1. Field

The present disclosure relates to heat exchangers, more specifically to headers for heat exchangers.

2. Description of Related Art

Heat exchangers are central to the functionality of numerous systems (e.g., in engines and environmental controls systems (ECS), e.g. for aircraft). On engines, heat exchangers are used for a variety of oil and air cooling applications. Heat exchangers are central to the operation of environmental control systems (air cycles) as well as other cooling systems. All of these applications continually require increases in heat transfer performance, reductions in pressure loss, and reductions in size and weight.

Current heat exchanger offerings are dominated by plate fin construction, with tube shell and plate-type heat exchangers having niche applications. Traditional plate fin construction imposes multiple design constraints that inhibit performance, increase size and weight, suffer structural reliability issues, are unable to meet future high temperature applications, and limit system integration opportunities.

Certain heat exchangers require transitioning from pipe flow to a layered arrangement in a heat exchanger core. These types of systems require special headers and can significantly impact the overall performance.

Such conventional methods and systems have generally been considered satisfactory for their intended purpose. However, there is still a need in the art for headers for heat exchangers. The present disclosure provides a solution for this need.

SUMMARY

A heat exchanger header includes a plurality of first flow channels and second flow channels, each flow channel including a fluid circuit opening for fluid communication with a fluid circuit of a heat source and a core opening for communication with a heat exchanger core, wherein at least the first flow channels include a lobe section defining a non-uniform cross-sectional flow area that changes along a flow direction. The non-uniform cross-sectional flow area can change in two dimensions along at least a portion of the lobe section, for example.

The non-uniform cross-sectional area can change non-linearly. In certain embodiments, the lobe section can have a bulb shape. In certain embodiments, at least the first flow channels can include a uniform section including a uniform cross-sectional area or a linearly changing cross-sectional flow area.

The lobe section can be disposed between the fluid circuit opening and the uniform section. The uniform section can be disposed between the lobe section and the core opening.

The lobe section can expand in flow area from the fluid circuit opening to a maximum flow area, wherein the lobe section then can reduce in flow area from the maximum flow area to the uniform section flow area.

The first flow channel can include a constantly expanding flow area from the flow circuit opening to the core opening in a first dimension and an expanding flow area at the lobe section in an orthogonal direction which then reduces from the lobe section toward the core opening.

The first flow channels can be hot flow channels and the second flow channels can be cold flow channels. Flow can be arranged to be counter-flow between the first flow channels and the second flow channels, however, parallel flow is also contemplated herein.

A heat exchanger, includes a core defining a plurality of core openings and a header as described above connected to the core.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
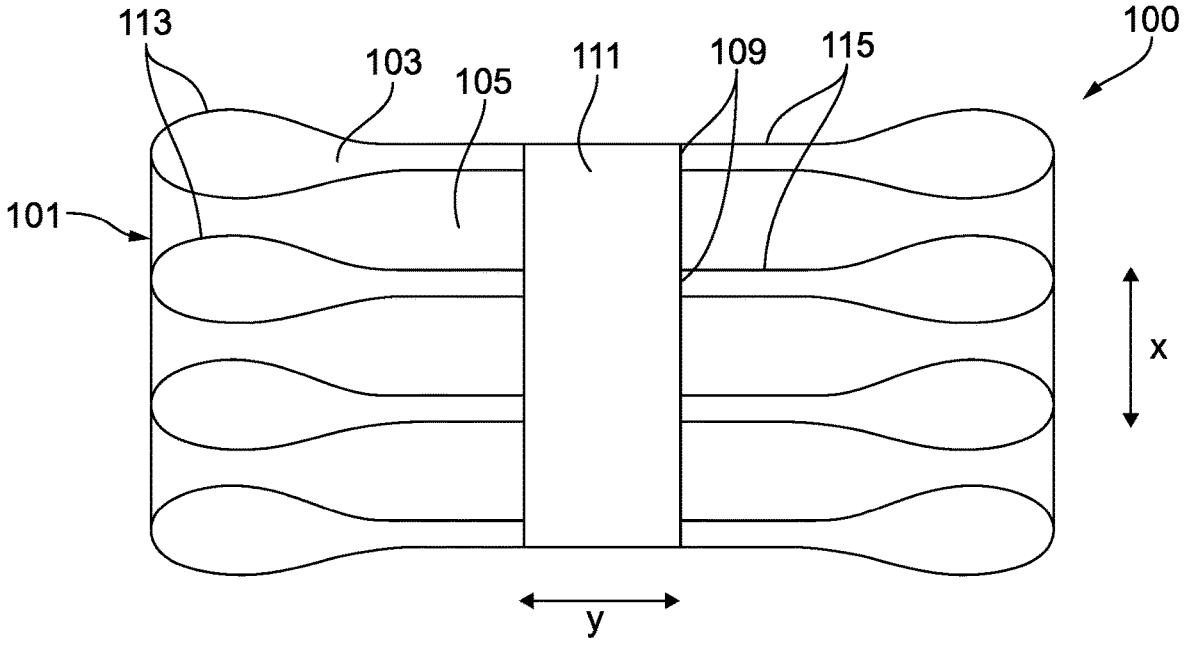
FIG. 1A is a rear view of an embodiment of a heat exchanger in accordance with this disclosure.

Reference will now be made to the drawings wherein like reference numerals identify similar structural features or aspects of the subject disclosure. For purposes of explanation and illustration, and not limitation, an illustrative view of an embodiment of a heat exchanger in accordance with the disclosure is shown in FIG. 1A and is designated generally by reference character 100. Other embodiments and/or aspects of this disclosure are shown in FIGS. 1B-4E. The systems and methods described herein can be used to improve heat exchanger efficiency, for example.

Figure 1B:
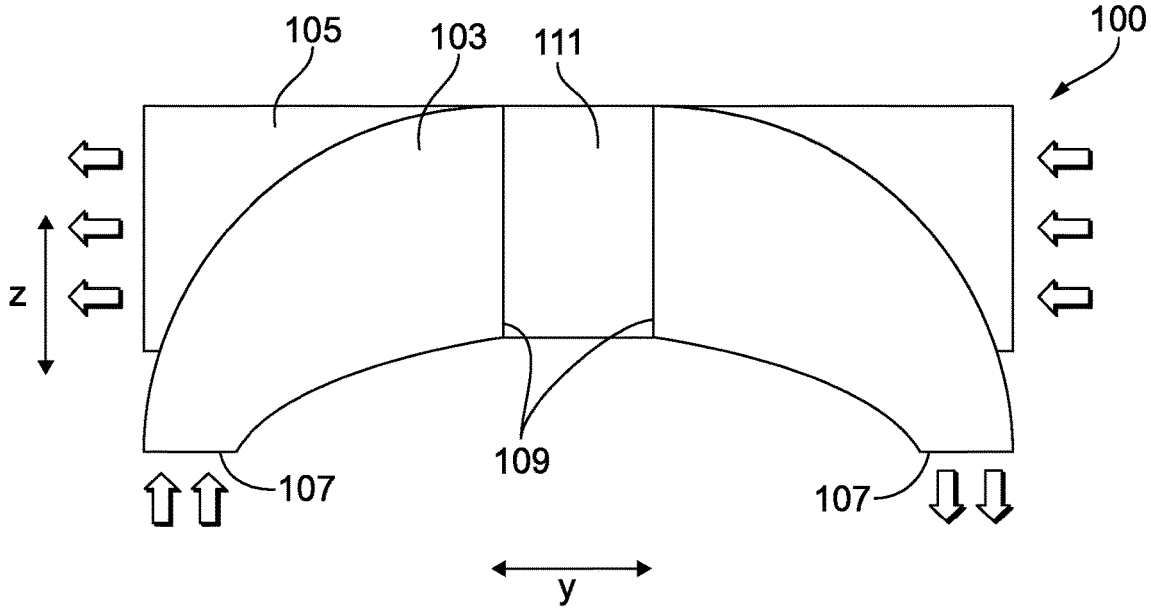
FIG. 1B is a top plan view of the embodiment of a heat exchanger of FIG. 1A.
Figure 1C:
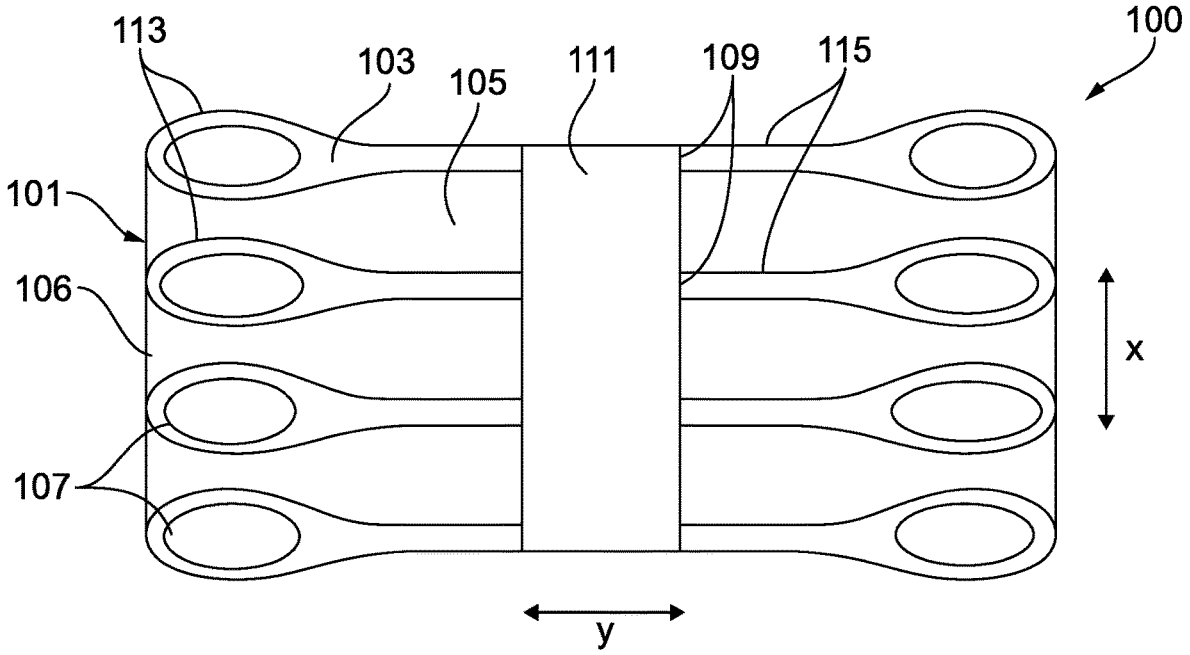
FIG. 1C is a front view of the embodiment of a heat exchanger of FIG. 1A.
Figure 1D:
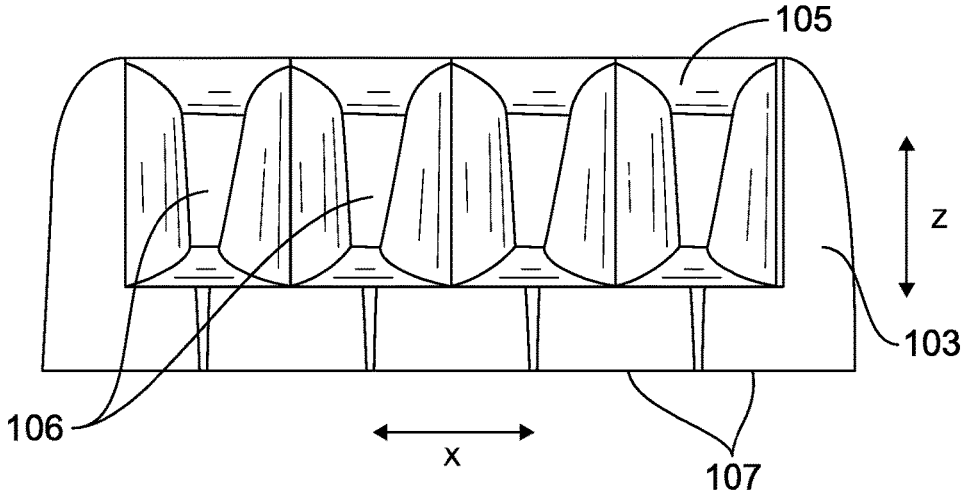
FIG. 1D is a side view of the embodiment of a heat exchanger of FIG. 1A.
Figure 1E:
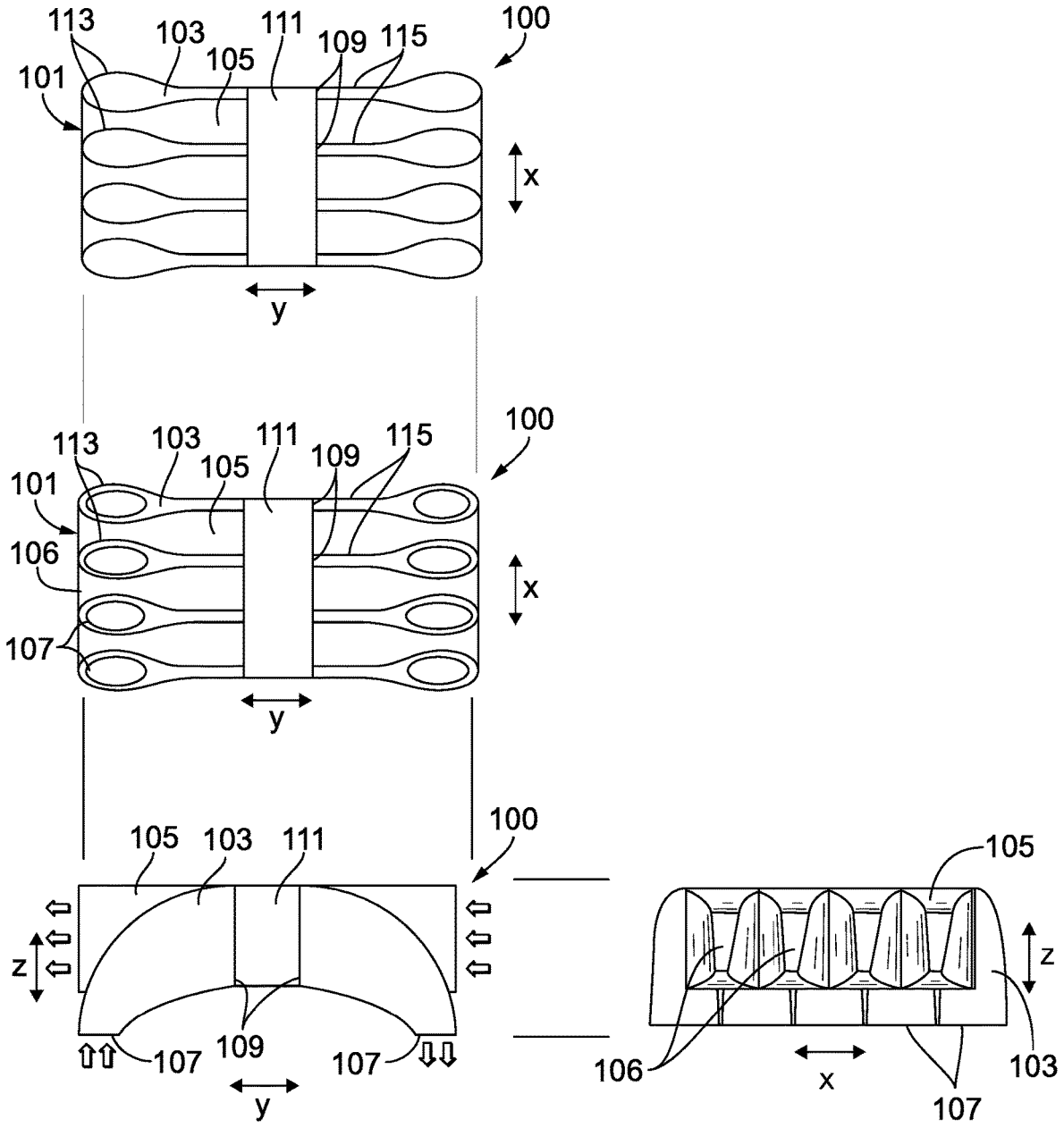
FIG. 1E is a schematic indicating the orientation of the of the embodiment of a heat exchanger of FIGS. 1A-1D.

Referring to FIGS. 1A-1E, a heat exchanger 100 includes a header 101 that has a plurality of first flow channels 103 and second flow channels 105. Each flow channel 103, 105 includes a fluid circuit opening 106, 107 (e.g., as shown in FIG. 1B) for fluid communication with a fluid circuit (not shown) of a heat source (e.g., an aircraft system, not shown) and a core opening 109 for communication with a heat exchanger core 111. For example, fluid circuit opening 107 can be a hot flow opening and fluid circuit opening 106 can be a cold flow opening.

At least the first flow channels 103 can include a lobe section 113 (e.g., as shown in FIG. 1A) defining a non-uniform cross-sectional flow area that changes along a flow direction. The non-uniform cross-sectional flow area can change in at least two dimensions (e.g., in the x and y axes as shown) along at least a portion of the lobe section 113, for example. In certain embodiments, the lobe section 113 can become wider in the x-axis from the fluid circuit opening 107 toward the core 111 and can become wider in the y-axis and/or z-axis simultaneously.

As shown, the non-uniform cross-sectional area can change non-linearly. In certain embodiments, the lobe section 113 can have a bulb shape as shown. In certain embodiments, at least the first flow channels 103 can include a uniform section 115 including a uniform cross-sectional area or a linearly changing cross-sectional flow area.

The lobe section 113 can be disposed between the fluid circuit opening 107 and the uniform section 115. Similarly, the uniform section 115 can be disposed between the lobe section 113 and the core opening 111. A transition can exist between the non-uniform flow area and a uniform flow area. Certain embodiments do not include a uniform section 115.

As shown, the lobe section 113 can expand in flow area from the fluid circuit opening 107 to a maximum flow area. The lobe section 113 then can reduce in flow area from the maximum flow area to the uniform section 115 flow area.

Restated, the first flow channel 103 can include a constantly expanding flow area from the flow circuit opening 107 to the core opening 109 in a first dimension (e.g., the y-axis and/or the z-axis) and an expanding flow area at the lobe section 113 in an orthogonal direction (e.g., in the x-axis) which then reduces from the lobe section 113 toward the core opening 109.

In certain embodiments, total flow area from flow circuit opening 107 of the first channels 103 is no more than total flow at the point of entering core 111 to prevent flow diffusion and then constriction again. In this regard, the lobe section 113 flow area can be sized to provide an expansion, e.g., in the x-axis, until the expansion in the z-axis and/or y-axis is at a maximum width in the x-axis is reached, at which point a reduction in the width in the x-axis can be had since the expansion in the z-axis and/or y-axis is sufficient to maintain a constant total flow area, a constantly expanding total flow area, or a constantly reducing total flow area from the flow circuit opening 107 to the core opening 109.

The first flow channels 103 can be hot flow channels and the second flow channels 105 can be cold flow channels, however, it is contemplated the channels 103, 105 can be used for hot or cold flow. Flow can be arranged to be counter-flow between the first flow channels 103 and the second flow channels 105, however, parallel flow is also contemplated herein.

Figure 2A:
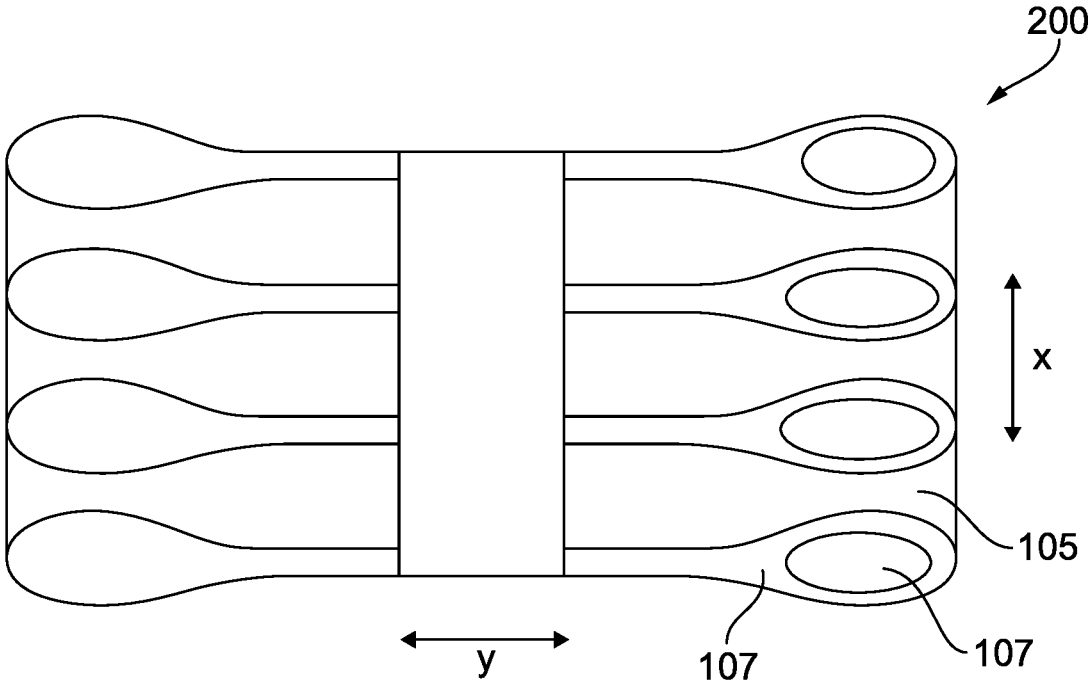
FIG. 2A is a rear view of an embodiment of a heat exchanger in accordance with this disclosure.
Figure 2B:
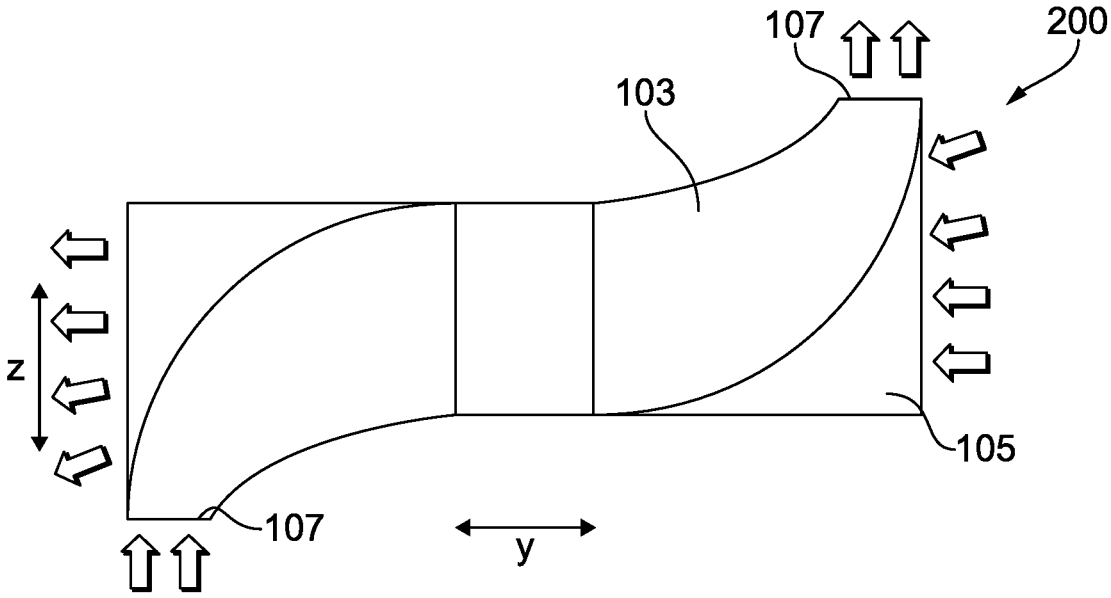
FIG. 2B is a top plan view of the embodiment of a heat exchanger of FIG. 2A.

As shown in FIG. 1B, the first flow channels 103 can include a curved shape in the y-z plane (e.g., to form a U-shape). As shown, the flow circuit openings 107 can both be configured to face down. Referring to FIGS. 2A and 2B, certain embodiments of a heat exchanger 200 can include first flow channels 107 that have flow circuit openings 107 in opposite or otherwise different directions (e.g., to form an S-shape).

Figure 3A:
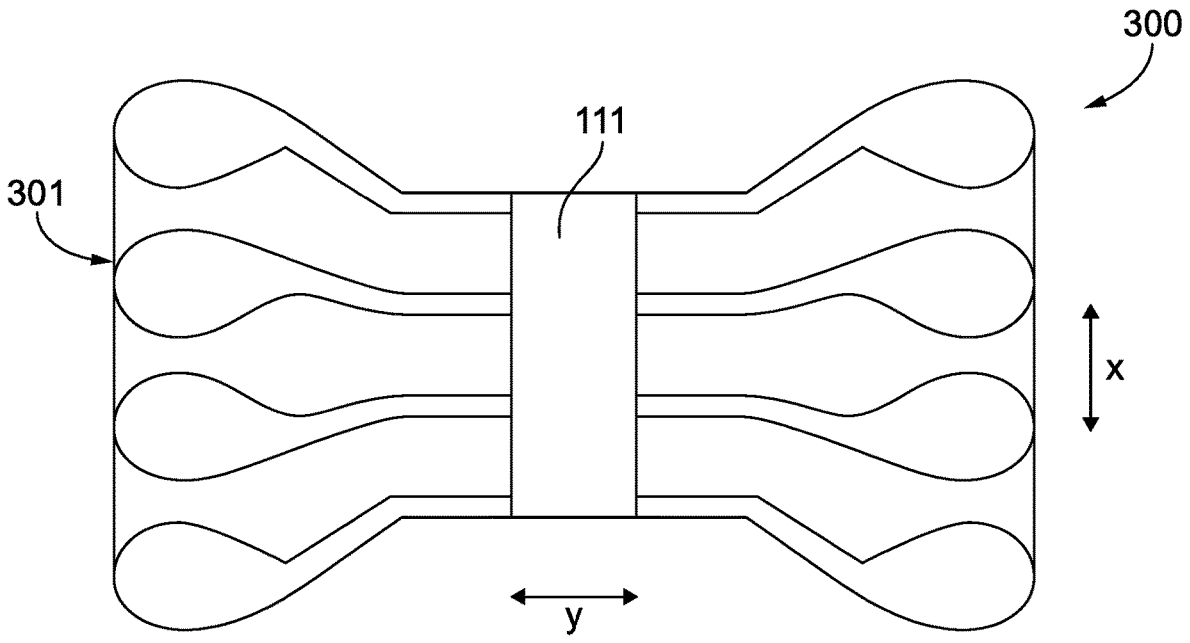
FIG. 3A is a rear view of an embodiment of a heat exchanger in accordance with this disclosure.
Figure 3B:
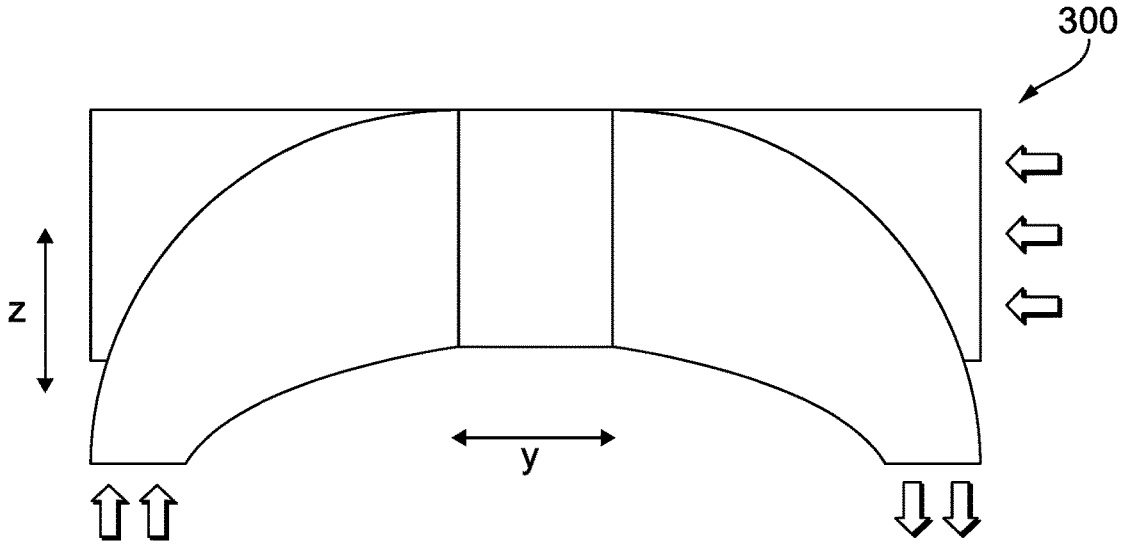
FIG. 3B is a top plan view of the embodiment of a heat exchanger of FIG. 3A.
Figure 4A:
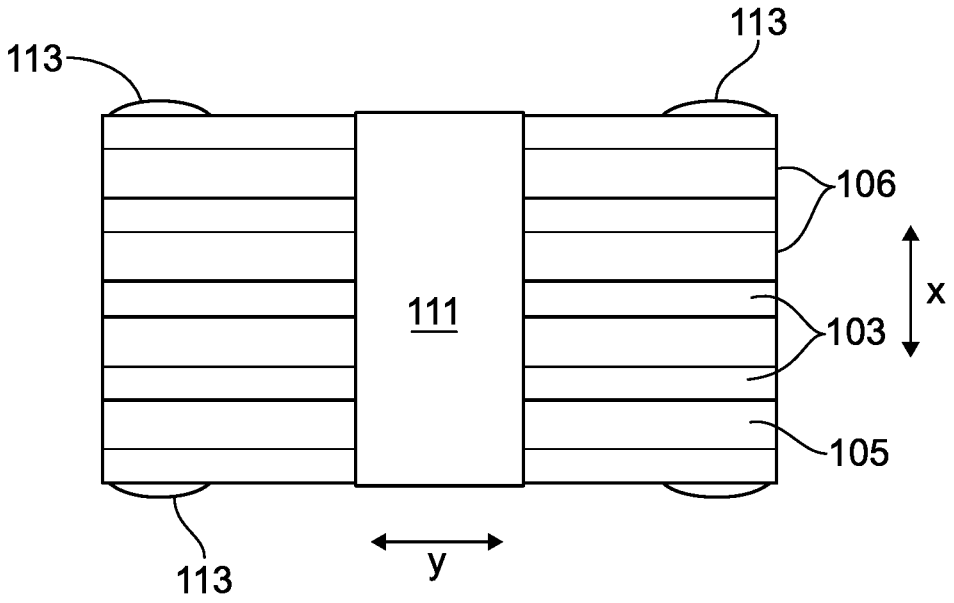
FIG. 4A is a rear view of an embodiment of a heat exchanger in accordance with this disclosure.
Figure 4B:
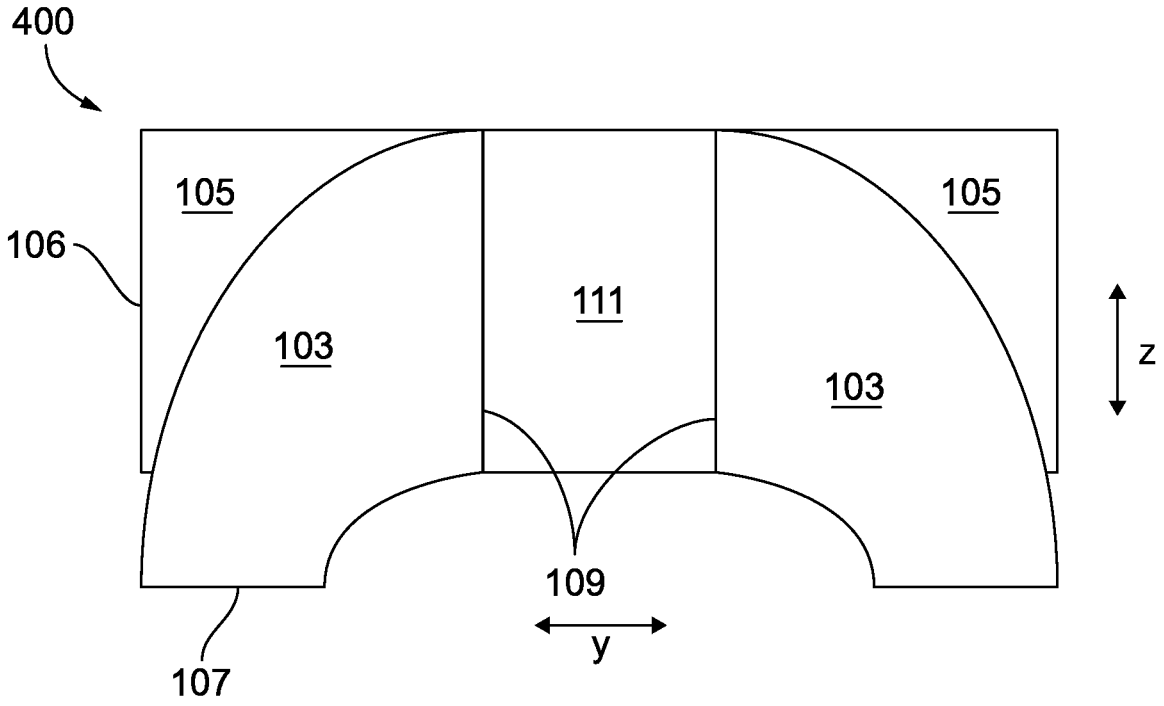
FIG. 4B is a top plan view of the embodiment of a heat exchanger of FIG. 4A.
Figure 4C:
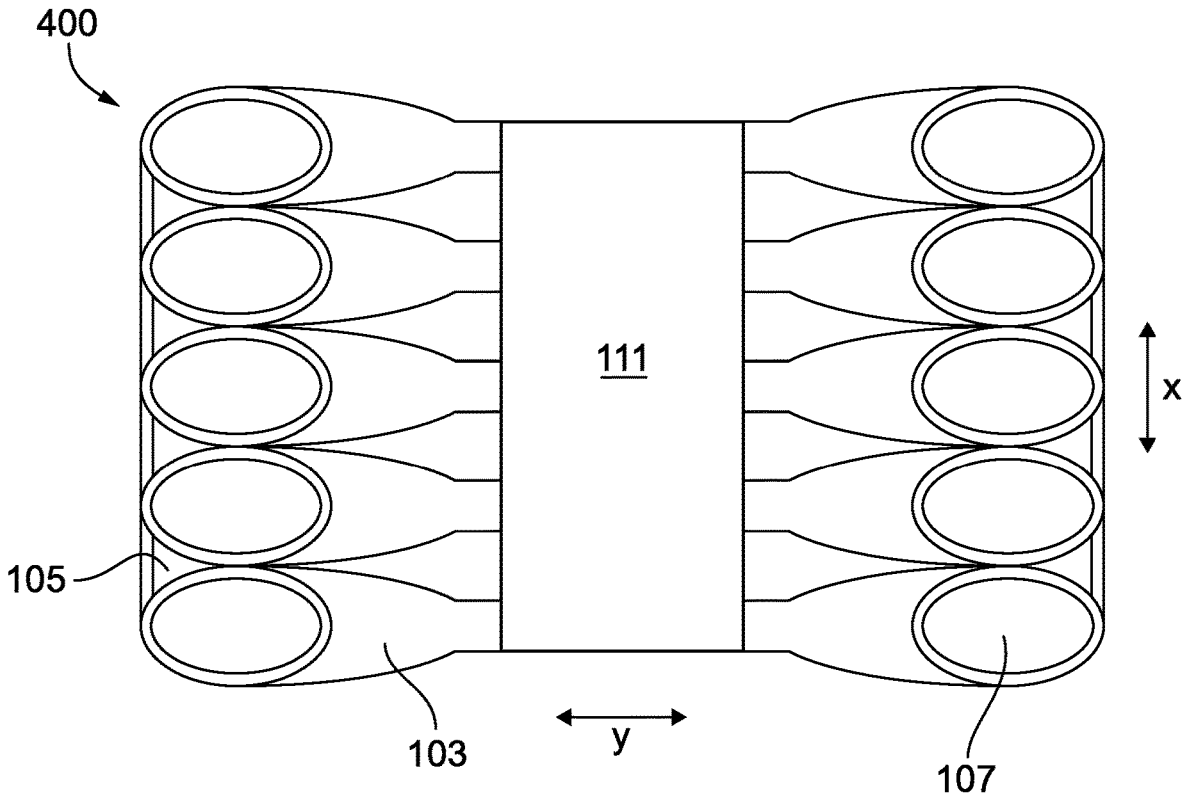
FIG. 4C is a front view of the embodiment of a heat exchanger of FIG. 4A.
Figure 4D:
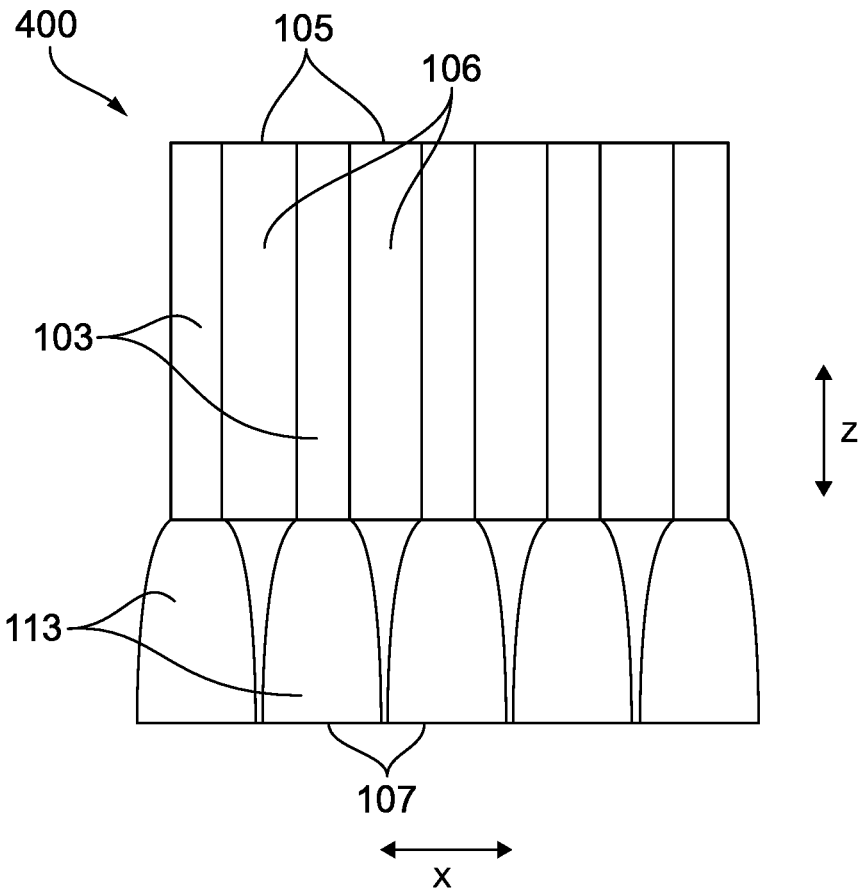
FIG. 4D is a side view of the embodiment of a heat exchanger of FIG. 4A.
Figure 4E:
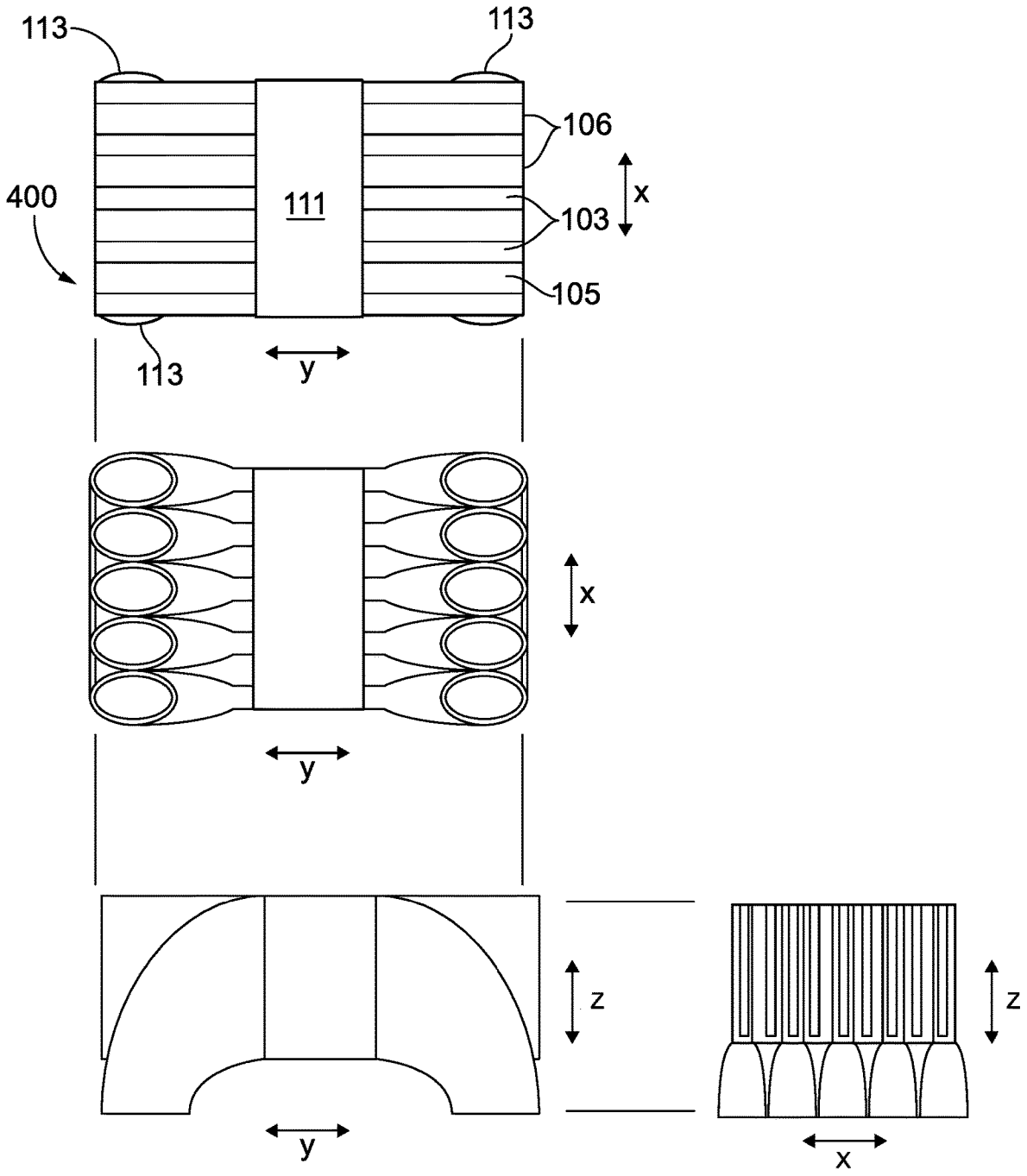
FIG. 4E is a schematic indicating the orientation of the of the embodiment of a heat exchanger of FIGS. 4A-4D.

Referring to FIGS. 3A and 3B, another embodiment of a heat exchanger 300 is shown. As shown, certain embodiments can include a header 301 that is wider (e.g., in the x-axis) than the core 111 but reduces down to the core 111 in total dimension, for example. The expansion could be symmetric as shown or could skew to one side or the other. Any suitable relative dimensions of the header 301 as compared to the core 111 are contemplated herein.

A total header width/height can be taller than the core 111 to mitigate pressure drop (e.g., as shown in FIG. 3). Embodiments of headers 101 are arranged in layers of hot and cold flow and contract or expand as in a scoop or nozzle, for example. By using taller channels away from the core, the hot-side flow velocities and pressure drops can be reduced. Increasing the height of the hot layers reduces the height of the cold-side layers if the total height of the headers is kept constant. By allowing the width of the header to vary, a similar increase in hot-side height can be used without significantly reducing cold-side flow area.

Also, as shown in the embodiment of FIG. 2B, the width of the second flow channels 105 can be increased (e.g., in the z-axis) by following the inside curve of the first flow channels 103, thereby mitigating the loss in flow area on the cold-side due to the increased height of the hot-side layers. In this case, at least part of the cold-side flow can follow a curve rather having a straight path though the device.

Referring to FIG. 4A-4E, another embodiment of a heat exchanger 400 is shown. As shown, the lobe section 113 can extend from the channels 103 such that the channels 103, 105 above the lobe section 113 are plate shaped (e.g., with a constant width in the x-axis). Any other suitable location and shape for the lobe sections 113 are contemplated herein.

The methods and systems of the present disclosure, as described above and shown in the drawings, provide for heat exchanger headers with superior properties. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A heat exchanger header, comprising:

a plurality of first flow channels and second flow channels, each flow channel of one of the first flow channels or the second flow channels including a fluid circuit opening for fluid communication with a fluid circuit of a heat source and a core opening for communication with a heat exchanger core, wherein at least the first flow channels include a lobe section defining a non-uniform cross-sectional flow area that changes along a flow direction, wherein at least the first flow channels include a uniform section including a uniform cross-sectional area or a linearly changing cross-sectional flow area, wherein each of the first flow channels are curved, wherein the lobe section expands in flow area at and from a point at the fluid circuit opening in a width to a point of maximum flow area, wherein the lobe section reduces in height from the point of maximum flow area to the beginning of the uniform section flow area.

2. The header of claim 1, wherein the non-uniform cross-sectional flow area changes in two dimensions along at least a portion of the lobe section.

3. The header of claim 2, wherein the non-uniform cross-sectional area changes non-linearly.

4. The header of claim 3, wherein the lobe section has a bulb shape.

5. The header of claim 1, wherein the lobe section is disposed between the fluid circuit opening and the uniform section.

6. The header of claim 5, wherein the uniform section is disposed between the lobe section and the core opening.

7. The header of claim 1, wherein each first flow channel is constantly expanding from the flow circuit opening to the core opening in the width and is expanding from an edge of the lobe section to a midpoint of the lobe section in an orthogonal direction to the width and then reduces in the orthogonal direction from the midpoint of the lobe section toward the core opening.

8. The header of claim 1, wherein the first flow channels are hot flow channels and the second flow channels are cold flow channels.

9. A heat exchanger, comprising:

a core defining a plurality of core openings; and a header connected to the core, the header including a plurality of first flow channels and second flow channels, each flow channel of one of the first flow channels or the second flow channels including a fluid circuit opening for fluid communication with a fluid circuit of a heat source and a core opening for communication with a heat exchanger core, wherein at least the first flow channels include a lobe section defining a non-uniform cross-sectional flow area that changes along a flow direction, wherein each of the first flow channels are curved, wherein each first flow channel is constantly expanding in a width from the flow circuit opening to the core opening and is expanding from an edge of the lobe section to a midpoint of the lobe section in an orthogonal direction to the width and then reduces in the orthogonal direction from the midpoint of the lobe section toward the core opening.

10. The heat exchanger of claim 9, wherein the non-uniform cross-sectional flow area changes in two dimensions along at least a portion of the lobe section.

11. The heat exchanger of claim 10, wherein the non-uniform cross-sectional area changes non-linearly.

12. The heat exchanger of claim 11, wherein the lobe section has a bulb shape.

13. The heat exchanger of claim 9, wherein at least the first flow channels include a uniform section including a uniform cross-sectional area or a linearly changing cross-sectional flow area.

* * * * *